US011053897B2

(12) United States Patent
Sakurai

(10) Patent No.: US 11,053,897 B2
(45) Date of Patent: Jul. 6, 2021

(54) AIR INTAKE APPARATUS

(71) Applicant: AISIN SEIKI KABUSHIKI KAISHA, Aichi-ken (JP)

(72) Inventor: Yu Sakurai, Obu (JP)

(73) Assignee: AISIN SEIKI KABUSHIKI KAISHA, Kariya (JP)

( * ) Notice: Subject to any disclaimer, the term of this patent is extended or adjusted under 35 U.S.C. 154(b) by 92 days.

(21) Appl. No.: 16/605,887

(22) PCT Filed: Feb. 23, 2018

(86) PCT No.: PCT/JP2018/006753
§ 371 (c)(1),
(2) Date: Oct. 17, 2019

(87) PCT Pub. No.: WO2018/198510
PCT Pub. Date: Nov. 1, 2018

(65) Prior Publication Data

US 2021/0123398 A1 Apr. 29, 2021

(30) Foreign Application Priority Data

Apr. 25, 2017 (JP) ..... JP2017-086313

(51) Int. Cl.
*F02M 35/10* (2006.01)
*F02M 35/112* (2006.01)
(Continued)

(52) U.S. Cl.
CPC ..... *F02M 35/10295* (2013.01); *F02B 75/20* (2013.01); *F02M 35/10118* (2013.01); *F02M 35/112* (2013.01); *F02B 2075/1816* (2013.01)

(58) Field of Classification Search
CPC ..... F02M 35/10295; F02M 35/10118; F02M 35/112; F02M 35/10; F02B 75/20; F02B 2075/1816
See application file for complete search history.

(56) References Cited

U.S. PATENT DOCUMENTS 5,740,770 A * 4/1998 Morota ..... F02B 27/0215 123/184.55
7,730,865 B2 * 6/2010 Yokoi ..... F02B 27/0294 123/184.55
(Continued)

FOREIGN PATENT DOCUMENTS

JP S63170567 U 11/1988
JP H532764 U 4/1993
(Continued)

OTHER PUBLICATIONS

International Search Report (with English translation) and Written Opinion issued in corresponding International Patent Application No. PCT/JP2018/006753, 10 pages (dated May 22, 2018).

*Primary Examiner* — Syed O Hasan
(74) *Attorney, Agent, or Firm* — Buchanan Ingersoll & Rooney PC

(57) ABSTRACT

An air intake apparatus includes a plurality of funnel-shaped portions provided in a plurality of intake ports. The plurality of funnel-shaped portions respectively include open ends located at positions at which lengths of the plurality of intake ports are aligned with each other, the open ends being provided along a direction perpendicular to a direction in which respective centerlines of the plurality of intake ports extend.

6 Claims, 10 Drawing Sheets

(51) Int. Cl.
*F02B 75/20* (2006.01)
*F02B 75/18* (2006.01)

(56) References Cited

U.S. PATENT DOCUMENTS

2008/0053394 A1* 3/2008 Tsutsui ..... F02M 35/1266
123/184.21
2008/0308059 A1* 12/2008 Ota ..... F02M 35/10065
123/184.53

FOREIGN PATENT DOCUMENTS

JP H0882259 A 3/1996
JP H09222018 A 8/1997
JP 5812696 B2 11/2015

* cited by examiner

FIRST MODIFIED EXAMPLE

SECOND MODIFIED EXAMPLE

AIR INTAKE APPARATUS

TECHNICAL FIELD

The present invention relates to an air intake apparatus, and more particularly, it relates to an air intake apparatus including a plurality of intake ports through which air is supplied from a surge tank to cylinders

BACKGROUND ART

In general, a resin intake manifold (air intake apparatus) including a plurality of branch passages (intake ports) through which air is supplied from a surge tank to cylinders is known. Such an intake manifold is disclosed in Japanese Patent No. 5812696, for example.

Each of a plurality of branch passages of a resin intake manifold disclosed in Japanese Patent No. 5812696 includes funnel-shaped portions provided at its end on the surge tank side and including passage openings into which air flows from a surge tank. A plurality of passage openings are arranged along a direction in which the plurality of branch passages are aligned.

The plurality of branch passages of the resin intake manifold disclosed in Japanese Patent No. 5812696 each include a portion that curves in the direction in which the plurality of branch passages are aligned between its end on the surge tank side and its end on the cylinder side in order to avoid other installed equipment. Among the plurality of branch passages of the resin intake manifold disclosed in Japanese Patent No. 5812696, a branch passage disposed on the outermost side in the direction in which the plurality of branch passages are aligned is formed with the largest curvature. Furthermore, among the plurality of branch passages of the resin intake manifold disclosed in Japanese Patent No. 5812696, a branch passage disposed on the more inner side in the direction in which the plurality of branch passages are aligned is formed with a smaller curvature. Accordingly, the lengths of the plurality of branch passages of the resin intake manifold disclosed in Japanese Patent No. 5812696 from their ends on the surge tank side to their ends on the cylinder side are different from each other.

PRIOR ART

Patent Document

Patent Document 1: Japanese Patent No. 5812696

SUMMARY OF THE INVENTION

Problem to be Solved by the Invention

However, in the resin intake manifold disclosed in Japanese Patent No. 5812696, the lengths of the plurality of branch passages are different from each other, and thus the pulsation frequencies of the plurality of branch passages are different from each other. Thus, the resin intake manifold disclosed in Japanese Patent No. 5812696 has a problem that a pressure loss is likely to occur in the flow of air introduced into the branch passages (intake ports). Therefore, an air intake apparatus in which a pressure loss that occurs in the flow of the air introduced from the surge tank to the intake ports can be significantly reduced or prevented is desired.

The present invention has been proposed in order to solve the aforementioned problem, and an object of the present invention is to provide an air intake apparatus in which a pressure loss that occurs in the flow of air introduced from a surge tank to intake ports can be significantly reduced or prevented.

Means for Solving the Problem

In order to attain the aforementioned object, an air intake apparatus according to an aspect of the present invention includes a surge tank including a side opening, into which air is introduced via the side opening, a plurality of intake ports through which the air is introduced from the surge tank to each of a plurality of cylinders of an engine body, and a plurality of funnel-shaped portions provided at ends of the plurality of intake ports on a side of the surge tank. The plurality of funnel-shaped portions respectively include open ends located at positions at which lengths of the plurality of intake ports from ends thereof on the side of the surge tank to ends thereof on sides of the plurality of cylinders are aligned with each other, the open ends being provided along a direction perpendicular to a direction in which respective centerlines of the plurality of intake ports extend.

In the air intake apparatus according to this aspect of the present invention, as described above, in the plurality of intake ports, the lengths from the ends on the side of the surge tank to the ends on the sides of the cylinders are aligned with each other. Accordingly, the pulsation frequencies of the plurality of intake ports can be aligned with each other. Furthermore, the open ends are provided in the direction perpendicular to the centerlines of the intake ports, and thus it is possible to facilitate air inflow from the surge tank into the intake ports along the centerlines of the intake ports. Consequently, a pressure loss that occurs in the flow of the air introduced from the surge tank into the intake ports can be significantly reduced or prevented.

In the aforementioned air intake apparatus according to this aspect, a first straight line that connects first center points as positions of the respective centerlines of the plurality of intake ports at the open ends of the plurality of funnel-shaped portions adjacent to each other is preferably inclined with respect to a direction in which the plurality of intake ports are aligned.

According to this structure, the first straight line is inclined such that one of the open ends of the adjacent funnel-shaped portions is located closer to the cylinders (on the opposite side to the surge tank) than the other of the open ends of the adjacent funnel-shaped portions. Accordingly, even when a large curve is formed in one intake port, the extension of one intake port due to the curve can be adjusted by being offset by one funnel-shaped portion disposed closer to the cylinders (on the side of the surge tank). Consequently, the lengths of the plurality of intake ports can be easily aligned with each other.

In this case, the respective centerlines of the plurality of intake ports are preferably arcuate, centered on port center points, the open ends of the plurality of funnel-shaped portions preferably include inner edges on sides of the port center points, and outer edges located further away from the port center points than the inner edges, and the open ends of the plurality of funnel-shaped portions are preferably provided in such a manner as to be twisted along the direction in which the plurality of intake ports are aligned due to a second straight line that connects second center points in the direction in which the plurality of intake ports are aligned at the inner edges of the open ends of the plurality of adjacent funnel-shaped portions and a third straight line that connects third center points in the direction in which the plurality of intake ports are aligned at the outer edges of the plurality of adjacent funnel-shaped portions.

According to this structure, the open ends of the adjacent funnel-shaped portions provided along the direction perpendicular to the centerlines of the intake ports can be continuously connected along a direction inclined with respect to the direction in which the intake ports are aligned.

In the aforementioned air intake apparatus in which surfaces defined by the second straight line and the third straight line are provided in such a manner as to be twisted along the direction in which the intake ports are aligned, the inner edges of the plurality of adjacent funnel-shaped portions are preferably connected to each other with no step therebetween, and the outer edges of the plurality of adjacent funnel-shaped portions are preferably connected to each other with no step therebetween.

According to this structure, the open ends of the adjacent funnel-shaped portions provided along the direction perpendicular to the centerlines of the intake ports can be smoothly connected along the direction inclined with respect to the direction in which the intake ports are aligned. Thus, the pressure loss that occurs in the flow of the air introduced from the surge tank into the intake ports can be further significantly reduced or prevented.

In the aforementioned air intake apparatus according to this aspect, areas of openings in respective cross sections of the plurality of intake ports preferably increase from the sides of the plurality of cylinders toward the side of the surge tank, and among the plurality of funnel-shaped portions, an area of an opening of an open end of a funnel-shaped portion located closest to the side opening of the surge tank is preferably the largest, and an area of an opening of an open end of a funnel-shaped portion located further away from the side opening preferably becomes smaller.

According to this structure, the funnel-shaped portion is disposed closest to the side opening of the surge tank such that the area of the opening of the open end of the funnel-shaped portion into which air is least likely to flow from the surge tank can be maximized. Furthermore, the funnel-shaped portion is disposed further away from the side opening of the surge tank such that the area of the opening of the open end of the funnel-shaped portion into which air is more likely to flow from the surge tank can be made smaller. Consequently, the amount of air that flows into the plurality of intake ports can be made approximately uniform.

In the aforementioned air intake apparatus according to this aspect, ends of boundary walls of the plurality of adjacent funnel-shaped portions on the side of the surge tank each preferably have an arcuate shape that protrudes toward the surge tank.

According to this structure, it is possible to facilitate air inflow into the plurality of intake ports.

In the aforementioned air intake apparatus having the first center points, the straight line that connects the first center points at respective open ends of four funnel-shaped portions in a four-cylinder engine is preferably inclined throughout at a constant angle with respect to the direction in which the plurality of intake ports are aligned.

According to this structure, a disturbance in the flow of air that flows into the plurality of intake ports can be significantly reduced or prevented. Thus, the pressure loss that occurs in the air intake apparatus can be significantly reduced or prevented.

MODES FOR CARRYING OUT THE INVENTION

Figure 1:
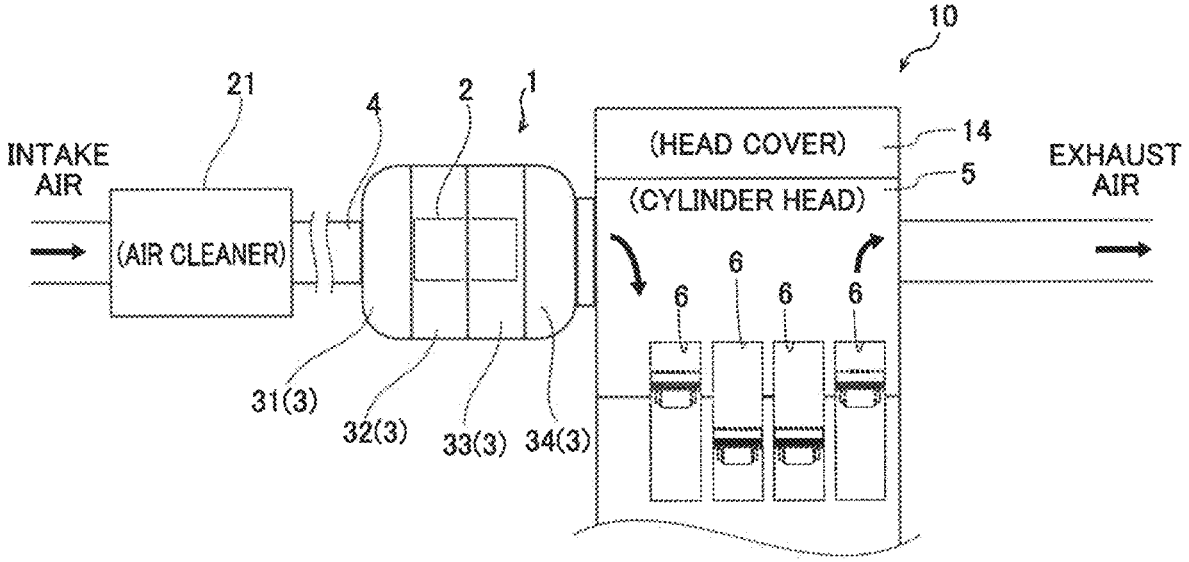
FIG. 1 A block diagram showing the structure of an air intake apparatus according to an embodiment of the present invention.

An embodiment of the present invention is hereinafter described on the basis of the drawings.

(Air Intake Apparatus)

The structure of an air intake apparatus 1 according to the embodiment of the present invention is now described with reference to FIGS. 1 to 13. In FIGS. 1 to 13, a direction in which a plurality of intake ports 3 are aligned is defined as an X direction. In the X direction, a direction toward the side on which a side opening 4 is arranged is defined as an X2 direction, and a direction toward the opposite side is defined as an X1 direction. In a horizontal plane, a direction orthogonal to the X direction is defined as a Y direction, a direction toward the engine 10 side is defined as a Y2 direction, and a direction toward the opposite side is defined as a Y1 direction. Furthermore, a direction orthogonal to the X direction and the Y direction is defined as a Z direction, a direction toward the surge tank 2 side in a lower piece 11 is defined as a Z1 direction, and a direction toward the opposite side is defined as a Z2 direction.

The air intake apparatus 1 is provided in an in-line four-cylinder engine 10 (an example of an engine body) for an automobile. The engine 10 includes a cylinder head 5, a cylinder block 14 below the cylinder head 5, and a head cover 15 above the cylinder head 5.

Figure 2:
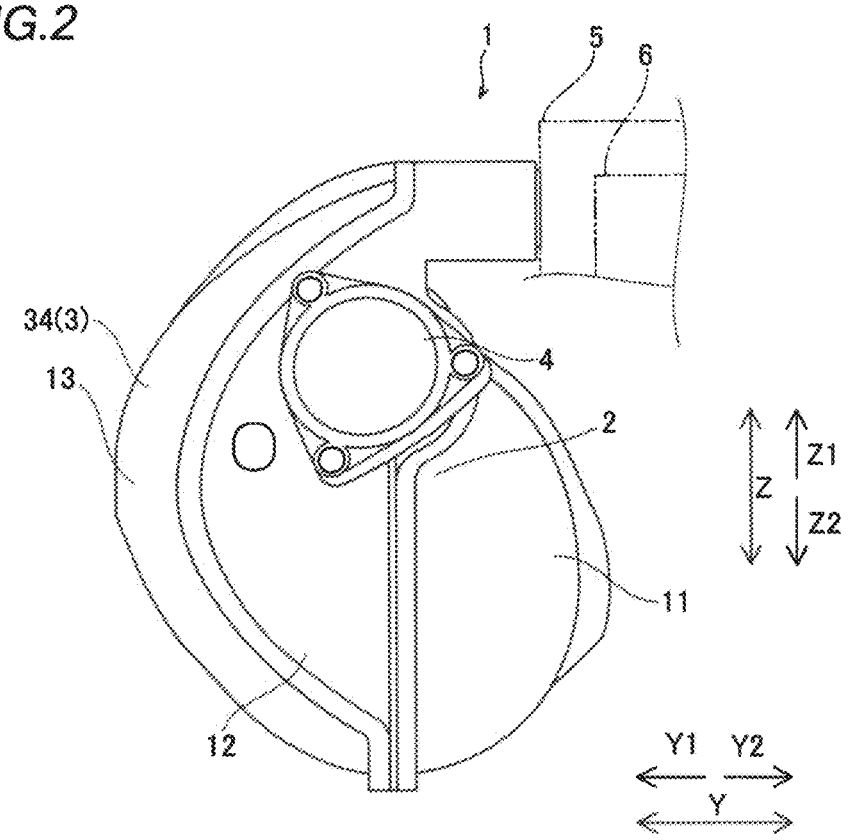
FIG. 2 A side view showing the structure of the air intake apparatus according to the embodiment of the present invention.

As shown in FIG. 1, the air intake apparatus 1 includes the surge tank 2 and the plurality of (four) intake ports 3. The surge tank 2 includes the side opening 4, and air supplied from an air cleaner 21 is introduced via the side opening 4. As shown in FIG. 2, each of the plurality of intake ports 3 is connected to the cylinder head 5 and is connected to each of a plurality of (four) cylinders 6 via the cylinder head 5. In the plurality of intake ports 3, air that reaches via the air cleaner 21 (see FIG. 1) and a throttle (not shown) flows from the surge tank 2 into each of the plurality of cylinders 6 of the engine 10. The intake ports 3 branch from the surge tank 2 and are arranged on the downstream side of the surge tank 2.

As shown in FIG. 2, the air intake apparatus 1 includes the lower piece 11, a middle piece 12, and an upper piece 13. The lower piece 11 is disposed on the Y2 side in the air intake apparatus 1. The upper piece 13 is disposed on the Y1 side in the air intake apparatus 1. The middle piece 12 is disposed between the lower piece 11 and the upper piece 13. The lower piece 11, the middle piece 12, and the upper piece 13 are integrally joined to each other by vibration welding. The intake ports 3 and the surge tank 2 are formed by integrally joining the lower piece 11, the middle piece 12 and the upper piece 13.

Figure 3:
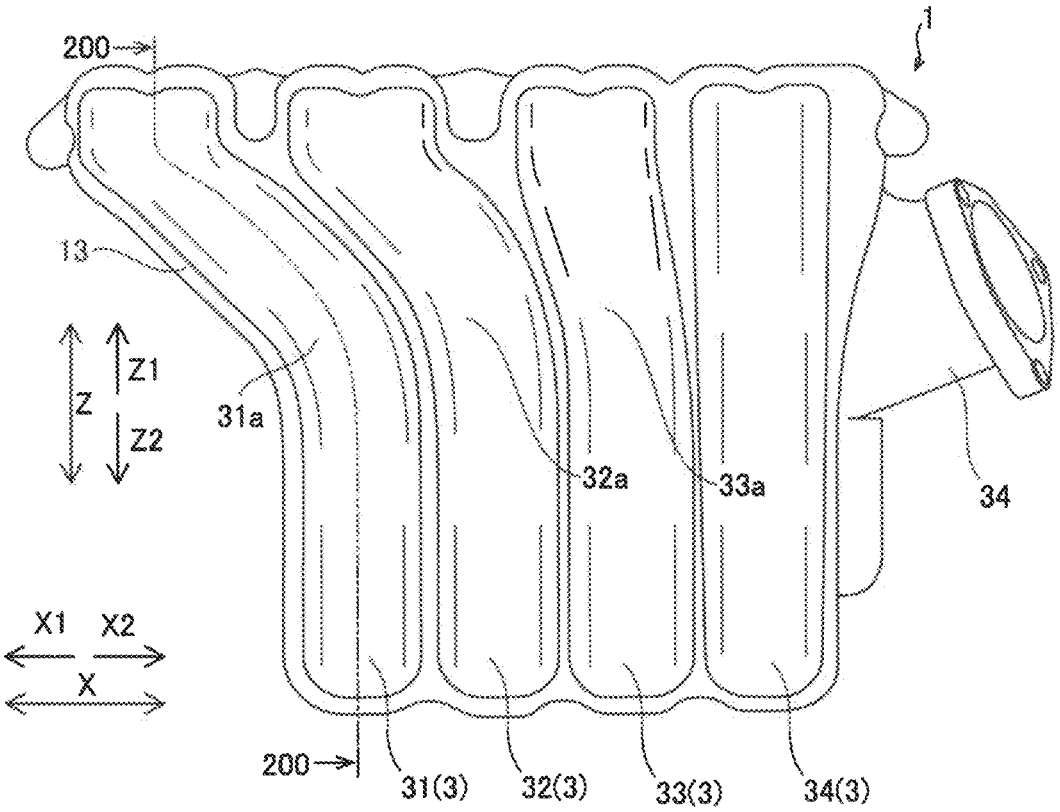
FIG. 3 A rear view showing the structure of the air intake apparatus according to the embodiment of the present invention.

As shown in FIG. 3, each of the plurality of intake ports 3 includes a first port 31, a second port 32, a third port 33, and a fourth port 34 in order from the X1 side. In the upper piece 13, the first port 31, the second port 32, the third port 33, and the fourth port 34 are each formed in a spiral shape in the direction orthogonal to the X direction.

The first port 31, the second port 32, and the third port 33 in the middle piece 12 and the upper piece 13 respectively include a first curved portion 31*a*, a second curved portion 32*a*, and a third curved portion 33*a*, each of which has a spiral portion curved in the X1 direction. The first curved portion 31*a* of the first port 31 is most strongly curved to the X1 side, the second curved portion 32*a* of the second port 32 is second most strongly curved to the X1 side, and the third curved portion 33*a* of the third port is least strongly curved to the X1 side. The fourth port 34 in the middle piece 12 and the upper piece 13 does not include a curved portion.

In the middle piece 12 and the upper piece 13, the length of the first port 31 in an air flow direction is longer than the length of the second port 32 in the air flow direction. In the upper piece 13, the length of the second port 32 in the air flow direction is longer than the length of the third port 33 in the air flow direction. In the upper piece 13, the length of the third port 33 in the air flow direction is longer than the length of the fourth port 34 in the air flow direction. Thus, in the middle piece 12 and the upper piece 13, the lengths of the first port 31, the second port 32, the third port 33, and the fourth port 34 in the air flow direction are different.

Figure 4:
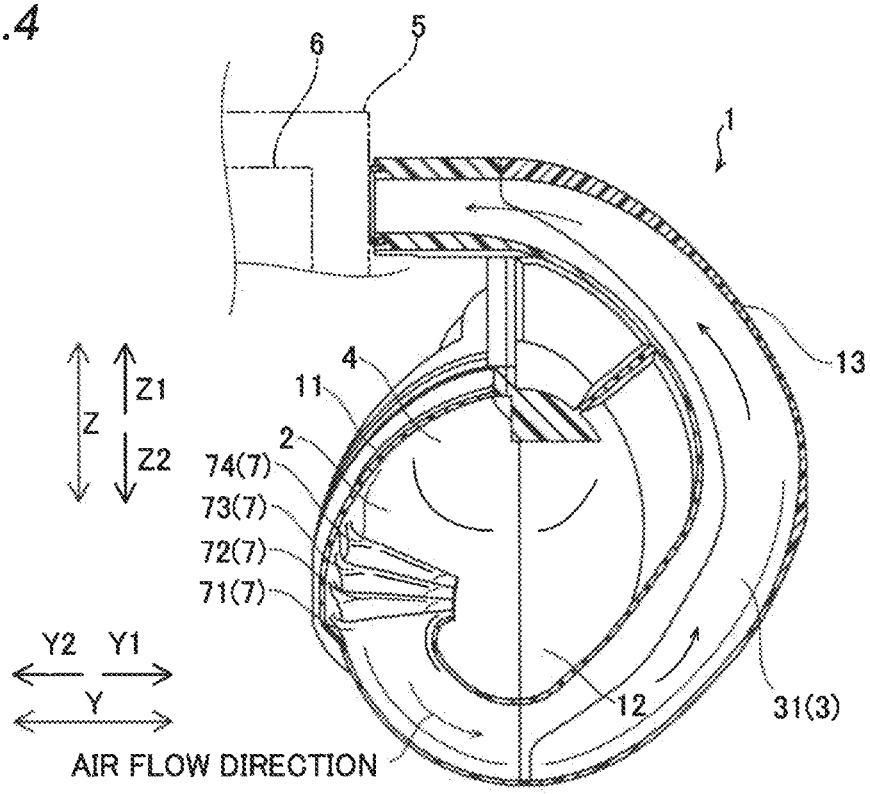
FIG. 4 A sectional view taken along the line 200-200 in FIG. 3.

As shown in FIG. 4, a funnel-shaped portion 7 is provided at an end (upstream end in the air flow direction) of each of the plurality of intake ports 3 on the surge tank 2 side in the lower piece 11. In the funnel-shaped portion 7, the end of the intake port 3 on the surge tank 2 side has a funnel shape in which the cross-sectional area of a flow passage gradually increases toward the surge tank 2 in order to improve the intake efficiency of the intake ports 3. A plurality of funnel-shaped portions 7 include a first funnel 71 provided in the first port 31, a second funnel 72 provided in the second port 32, a third funnel provided in the third port 33, and a fourth funnel 74 provided in the fourth port 34.

<Arrangement Position of Funnel-Shaped Portion>

As described above, in the middle piece 12 and the upper piece 13, the lengths of the first port 31, the second port 32, the third port 33, and the fourth port 34 in the air flow direction are different, and thus when the lengths of the first port 31, the second port 32, the third port 33, and the fourth port 34 in the air flow direction in the lower piece 11 are the same, the lengths of the first port 31, the second port 32, the third port 33, and the fourth port 34 in the air flow direction are different as a whole.

When the lengths of the first port 31, the second port 32, the third port 33, and the fourth port 34 in the air flow direction are different, the pulsation frequencies of the first port 31, the second port 32, the third port 33, and the fourth port 34 are different. In this case, it is difficult to increase the amount of air inflow from the first port 31, the second port 32, the third port 33, and the fourth port 34 in the plurality of cylinders 6 in the engine 10, respectively. Furthermore, a pressure loss is likely to occur in each of the first port 31, the second port 32, the third port 33, and the fourth port 34. Therefore, the plurality of funnel-shaped portions 7 according to this embodiment are arranged at positions at which the lengths of the plurality of intake ports 3 from their ends on the surge tank 2 side to their ends on the cylinder 6 side (the ends on the downstream side in the air flow direction) are aligned with each other. That is, the plurality of funnel-shaped portions 7 are arranged in such a manner that the lengths of the first port 31, the second port 32, the third port 33, and the fourth port 34 in the air flow direction are aligned with each other. The arrangement positions of the plurality of funnel-shaped portions 7 are described below.

Figure 5:
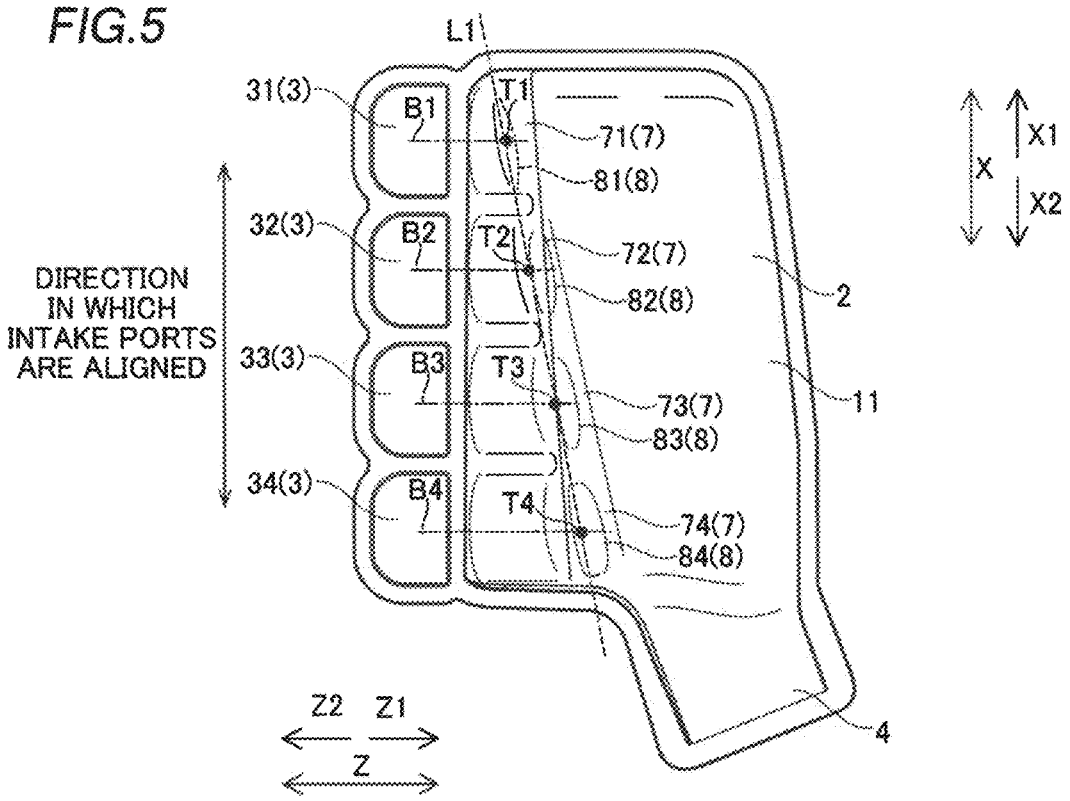
FIG. 5 A plan view showing a lower piece of the air intake apparatus according to the embodiment of the present invention.

As shown in FIGS. 3 and 4, in the middle piece 12 and the upper piece 13, the length of the first port 31 is the longest among the plurality of intake ports 3, and thus in the lower piece 11, the length of the first port 31 is the shortest among the plurality of intake ports 3. Therefore, as shown in FIGS. 4 and 5, the first funnel 71 is located closest to the cylinders 6 in the air flow direction as compared with the second funnel 72, the third funnel 73, and the fourth funnel 74.

In the middle piece 12 and the upper piece 13, the length of the second port 32 is the second longest among the plurality of intake ports 3, and thus in the lower piece 11, the length of the second port 32 is the second shortest among the plurality of intake ports 3. Therefore, as shown in FIGS. 4 and 5, the second funnel 72 is located closer to the cylinders 6 in the air flow direction than the third funnel 73 and the fourth funnel 74. Furthermore, the second funnel 72 is located closer to the surge tank 2 in the air flow direction than the first funnel 71.

In the middle piece 12 and the upper piece 13, the length of the third port 33 is the third longest among the plurality of intake ports 3, and thus in the lower piece 11, the length of the third port 33 is the third shortest among the plurality of intake ports 3. Therefore, as shown in FIGS. 4 and 5, the third funnel 73 is located closer to the cylinders 6 in the air flow direction than the fourth funnel 74. Furthermore, the third funnel 73 is located closer to the surge tank 2 in the air flow direction than the first funnel 71 and the second funnel 72.

In the middle piece 12 and the upper piece 13, the length of the fourth port 34 is the shortest among the plurality of intake ports 3, and thus in the lower piece 11, the length of the fourth port 34 is the longest among the plurality of intake ports 3. Therefore, as shown in FIGS. 4 and 5, the fourth funnel 74 is located closest to the surge tank 2 in the air flow direction as compared with the first funnel 71, the second funnel 72, and the third funnel 73.

<Open End of Funnel-Shaped Portion>

Figure 6:
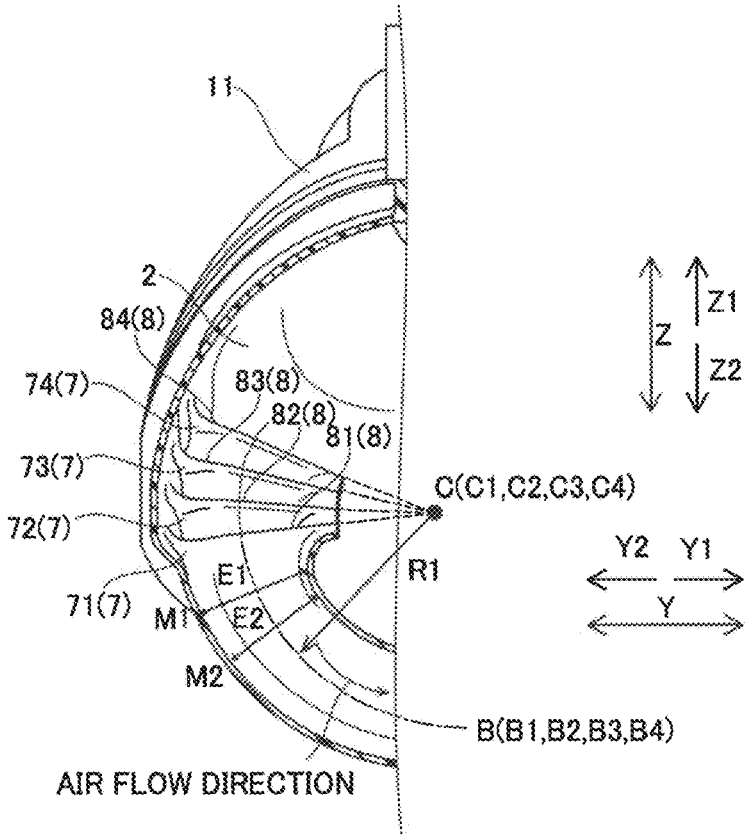
FIG. 6 A partial sectional view of FIG. 4 showing a plurality of funnel-shaped portions in the air intake apparatus according to the embodiment of the present invention.

As shown in FIG. 6, in the lower piece 11, the intake ports 3 are formed in such a manner that the centerlines B of the intake ports 3 are arcuate, centered on port center points C1, C2, C3, and C4, respectively. The port center points C1, C2, C3, and C4 are located on a straight line C (see FIG. 7). In each of the plurality of intake ports 3, the funnel-shaped portion 7 is provided with an open end 8 that is an opening that faces the surge tank 2. The open end 8 is inclined at a predetermined angle with respect to a direction in which the centerline B of the intake port 3 extends. If the predetermined angle is not perpendicular to the direction in which the centerline B of the intake port 3 extends, the opening area of the open end 8 viewed in a direction along the centerline B of the intake port 3 is decreased. In this case, in the intake port 3, a pressure loss occurs in the vicinity of the open end 8 due to the difficulty of air inflow from the open end 8. Therefore, the funnel-shaped portion 7 according to this embodiment includes the open end 8 formed along a direction perpendicular to the direction in which the centerline B of each of the plurality of intake ports 3 extends. The open end 8 of each of the plurality of funnel-shaped portions 7 is described below.

Figure 7:
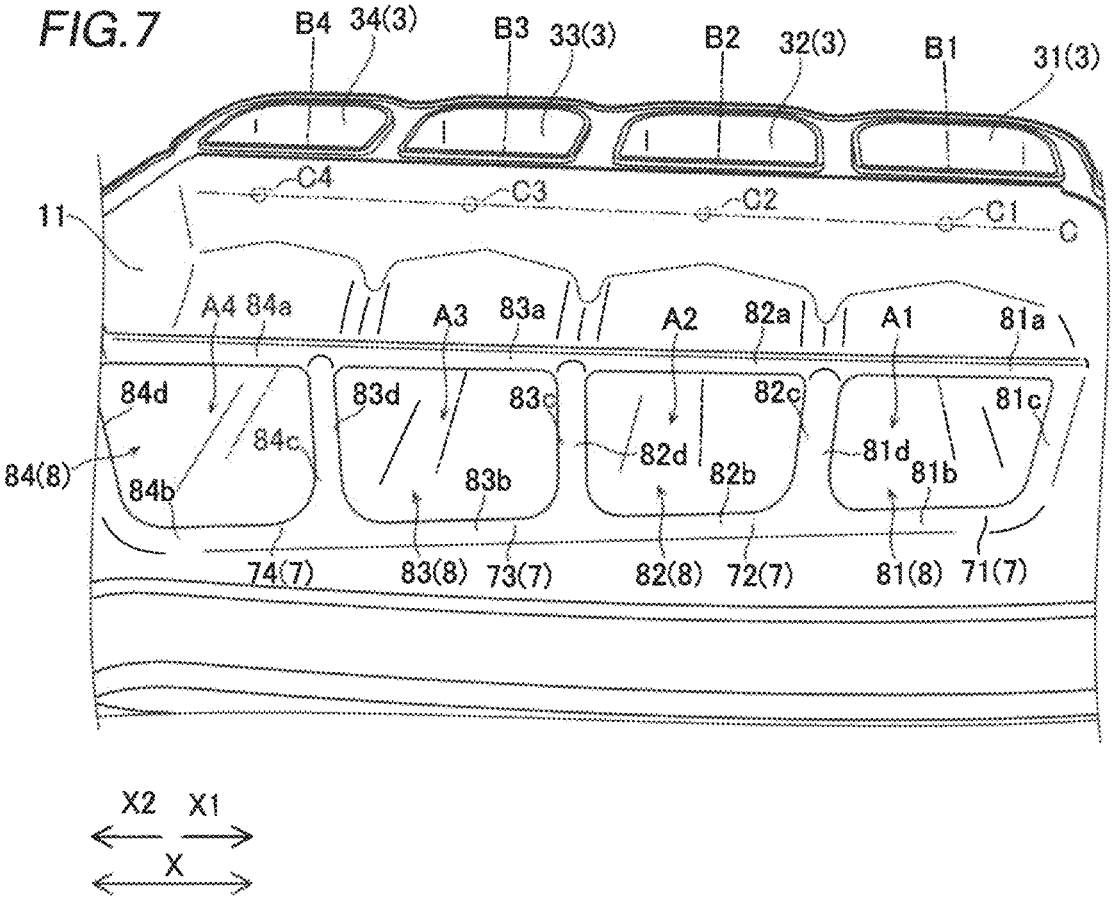
FIG. 7 A perspective view of the lower piece showing the plurality of funnel-shaped portions in the air intake apparatus according to the embodiment of the present invention.

As shown in FIG. 7, the first funnel 71 includes a first open end 81 as the open end 8 formed along the direction perpendicular to the direction in which the centerline B1 of the first port 31 extends in the lower piece 11. As shown in FIG. 6, the direction perpendicular to the direction in which the centerline B1 of the first port 31 extends passes through the first port center point C1 of the arcuate first port 31. As shown in FIG. 7, the first open end 81 is formed in a substantially rectangular shape as viewed in the direction in which the centerline B1 of the first port 31 extends. The first open end 81 of the first funnel 71 includes a first inner edge 81*a* on the first port center point C1 side, and a first outer edge 81*b* located further away from the first port center point C1 than the first inner edge 81*a*. The first open end 81 of the first funnel 71 includes a first one side edge 81*c* on one side (X1 side) in the direction (X direction) in which the plurality of intake ports 3 are aligned, and a first other side edge 81*d* on the other side (X2 side). In the first funnel 71, the area of an opening (hereinafter referred to as the first opening A1) of the first open end 81 is the area of a portion surrounded by the first inner edge 81*a*, the first outer edge 81*b*, and the first one side edge 81*c*, and the first other side edge 81*d*.

The second funnel 72 includes a second open end 82 as the open end 8 formed along the direction perpendicular to the direction in which the centerline B2 of the second port 32 extends in the lower piece 11. As shown in FIG. 6, the direction perpendicular to the direction in which the centerline B2 of the second port 32 extends passes through the second port center point C2 of the arcuate second port 32. As shown in FIG. 7, the second open end 82 is formed in a substantially rectangular shape as viewed in the direction in which the centerline B2 of the second port 32 extends. The second open end 82 of the second funnel 72 includes a second inner edge 82*a* on the second port center point C2 side, and a second outer edge 82*b* located further away from the second port center point C2 than the second inner edge 82*a*. The second open end 82 of the second funnel 72 includes a second one side edge 82*c* on one side (X1 side) in the direction (X direction) in which the plurality of intake ports 3 are aligned, and a second other side edge 82*d* on the other side (X2 side). In the second funnel 72, the area of an opening (hereinafter referred to as the second opening A2) of the second open end 82 is the area of a portion surrounded by the second inner edge 82*a*, the second outer edge 82*b*, the second one side edge 82*c*, and the second other side edge 82*d*.

The third funnel 73 includes a third open end 83 as the open end 8 formed along the direction perpendicular to the direction in which the centerline B3 of the third port 33 extends in the lower piece 11. As shown in FIG. 6, the direction perpendicular to the direction in which the centerline B3 of the third port 33 extends passes through the third port center point C3 of the arcuate third port 33. As shown in FIG. 7, the third open end 83 is formed in a substantially rectangular shape as viewed in the direction in which the centerline B3 of the third port 33 extends. The third open end 83 of the third funnel 73 includes a third inner edge 83*a* on the third port center point C3 side, and a third outer edge 83*b* located further away from the third port center point C3 than the third inner edge 83*a*. The third open end 83 of the third funnel 73 includes a third one side edge 83*c* on one side (X1 side) in the direction (X direction) in which the plurality of intake ports 3 are aligned, and a third other side edge 83*d* on the other side (X2 side). In the third funnel 73, the area of an opening (hereinafter referred to as the third opening A3) of the third open end 83 is the area of a portion surrounded by the third inner edge 83*a*, the third outer edge 83*b*, the third one side edge 83*c*, and the third other side edge 83*d*.

The fourth funnel 74 includes a fourth open end 84 as the open end 8 formed along the direction perpendicular to the direction in which the centerline B4 of the fourth port 34 extends in the lower piece 11. As shown in FIG. 6, the direction perpendicular to the direction in which the centerline B4 of the fourth port 34 extends passes through the fourth port center point C4 of the arcuate fourth port 34. As shown in FIG. 7, the fourth open end 84 is formed in a substantially rectangular shape as viewed in the direction in which the centerline B4 of the fourth port 34 extends. The fourth open end 84 of the fourth funnel 74 includes a fourth inner edge 84*a* on the fourth port center point C4 side, and a fourth outer edge 84*b* located further away from the fourth port center point C4 than the fourth inner edge 84*a*. The fourth open end 84 of the fourth funnel 74 includes a fourth one side edge 84*c* on one side (X1 side) in the direction (X direction) in which the plurality of intake ports 3 are aligned, and a fourth other side edge 84*d* on the other side (X2 side). In the fourth funnel 74, the area of an opening (hereinafter referred to as the fourth opening A4) of the fourth open end 84 is the area of a portion surrounded by the fourth inner edge 84*a*, the fourth outer edge 84*b*, the fourth one side edge 84*c*, and the fourth other side edge 84*d*.

In the air intake apparatus 1, the areas of the openings in the cross sections of the plurality of intake ports 3 increase from the cylinder 6 side toward the surge tank 2 side. Specifically, as shown in FIG. 8, at the first open end 81, the length E1 in a direction orthogonal to the centerline B1 of the first port 31 at a spot M1 of the first port 31 is longer than the length E2 in the direction orthogonal to the centerline B1 of the first port 31 at a spot M2 of the first port 31.

Figure 8:
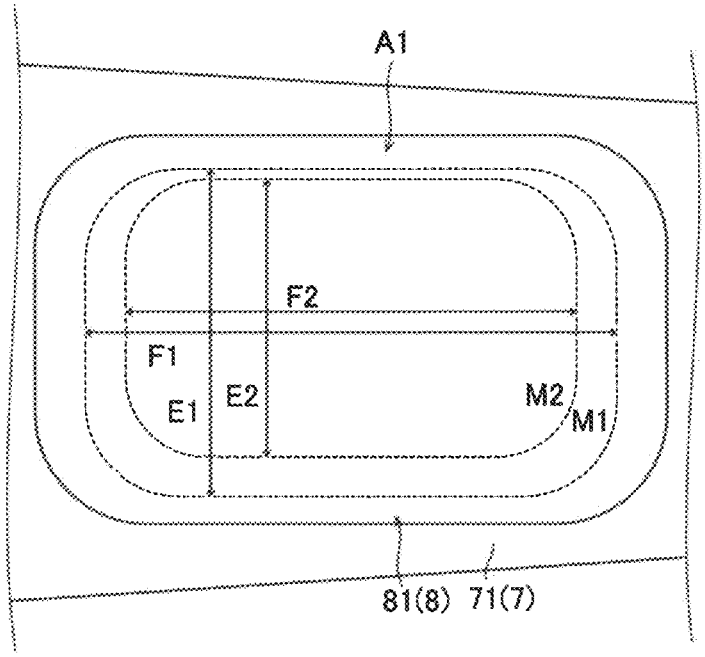
FIG. 8 A schematic view of a first open end of a first funnel in the air intake apparatus according to the embodiment of the present invention.

Furthermore, as shown in FIG. 8, the length F1 in the direction (X direction) in which the plurality of intake ports 3 are aligned at the spot M1 of the first port 31 is longer than the length (F2) in the direction (X direction) in which the plurality of intake ports 3 are aligned at the spot M2 of the first port 31. Thus, the area of the opening in the cross section at the spot M1 of the first port 31 is larger than the area of the opening in the cross section at the spot M2 of the first port 31. Although the first port 31 of the plurality of intake ports 3 has been described, the second port 32, the third port 33, and the fourth port 34 have the same structure.

Thus, in the air intake apparatus 1, the area of the opening of the open end 8 of the funnel-shaped portion 7 located closest to the side opening 4 in the surge tank 2 among the plurality of funnel-shaped portions 7 is the largest, and the areas of the openings of the open ends 8 of the funnel-shaped portions 7 become smaller as the funnel-shaped portions 7 are located further away from the side opening 4. Specifically, the areas of the openings of the intake ports 3 decrease from the surge tank 2 side toward the cylinder 6 side in the air flow direction, and thus the opening of the funnel-shaped portion 7 located closer to the cylinders 6 has a smaller area.

As shown in FIG. 6, the first funnel 71 among the plurality of funnel-shaped portions 7 is located closer to the cylinders 6 than the second funnel 72, the third funnel 73, and the fourth funnel 74 in the air flow direction. Therefore, as shown in FIG. 7, the area of the first opening A1 of the first funnel 71 is the smallest among the plurality of funnel-shaped portions 7.

The second funnel 72 of the plurality of funnel-shaped portions 7 is disposed closer to the cylinders 6 than the third funnel 73 and the fourth funnel 74 in the air flow direction, and is located closer to the surge tank 2 than the first funnel 71. Therefore, the area of the second opening A2 of the second funnel 72 is the second smallest among the plurality of funnel-shaped portions 7.

The third funnel 73 of the plurality of funnel-shaped portions 7 is located closer to the cylinders 6 than the fourth funnel 74 in the air flow direction, and is located closer to the surge tank 2 than the first funnel 71 and the second funnel 72. Therefore, the area of the third opening A3 of the third funnel 73 is the third smallest among the plurality of funnel-shaped portions 7.

The fourth funnel 74 of the plurality of funnel-shaped portions 7 is located closer to the surge tank 2 than the first funnel 71, the second funnel 72, and the third funnel 73 in the air flow direction. Therefore, the area of the fourth opening A4 of the fourth funnel 74 is the largest among the plurality of funnel-shaped portions 7.

<Connection between Funnel-Shaped Portions>

Figure 9:
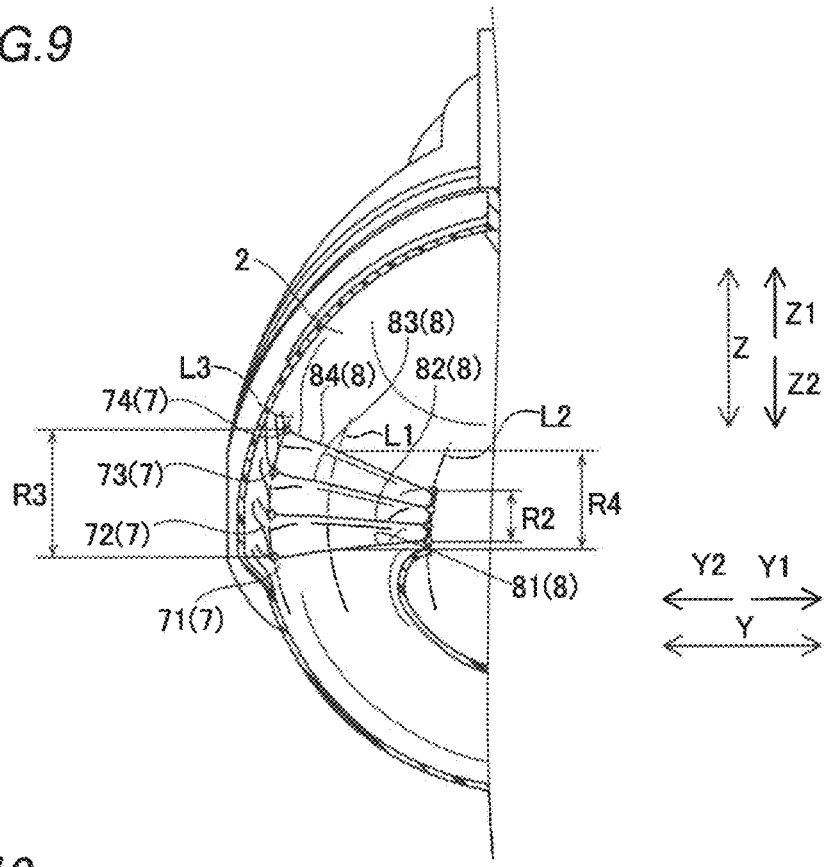
FIG. 9 A partial sectional view of FIG. 4 showing the plurality of funnel-shaped portions and open ends thereof in the air intake apparatus according to the embodiment of the present invention.
Figure 11:
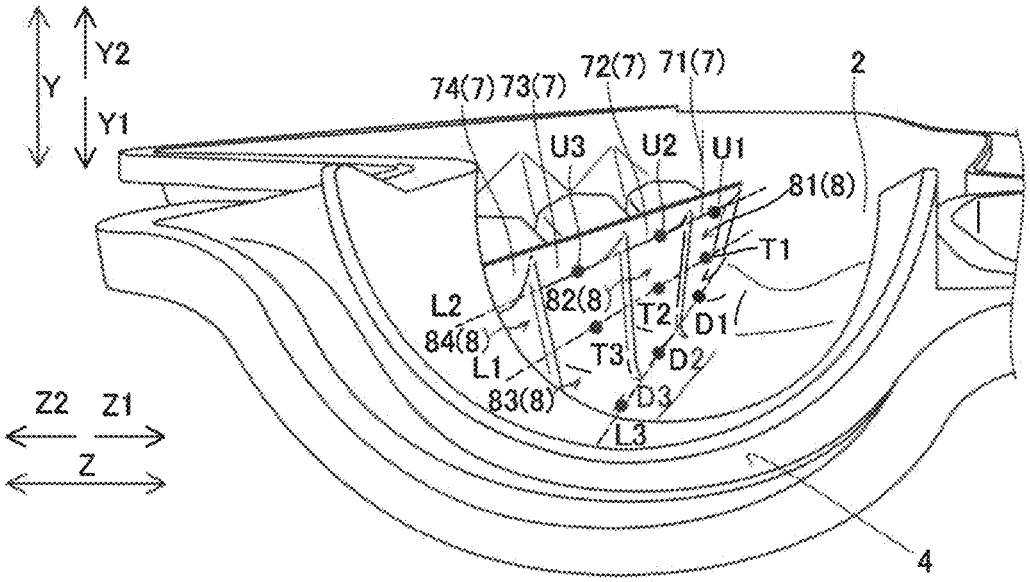
FIG. 11 A perspective view of the lower piece showing the plurality of funnel-shaped portions as viewed from a side opening in the air intake apparatus according to the embodiment of the present invention.

As shown in FIG. 9, in the air intake apparatus 1, the lengths of the plurality of intake ports 3 from their ends on the surge tank 2 side to their ends on the cylinder 6 side are aligned, and the open ends 8 of the plurality of intake ports 3 are perpendicular to the direction in which the centerlines B of the intake ports 3 extend. As shown in FIG. 5, a first straight line L1 that connects first center points T1, T2, T3, and T4 as the positions of the centerlines B of the intake ports 3 at the open ends 8 of the adjacent funnel-shaped portions 7 is inclined with respect to the direction (X direction) in which the plurality of intake ports 3 are aligned. The entire first straight line L1 is inclined at the same angle with respect to the direction (X direction) in which the plurality of intake ports 3 are aligned. In the air intake apparatus 1 according to this embodiment, the plurality of funnel-shaped portions 7 are continuously connected such that the shapes of the plurality of funnel-shaped portions 7 are twisted, as shown in FIG. 11. The shapes of the funnel-shaped portions 7 are described below.

Figure 10:
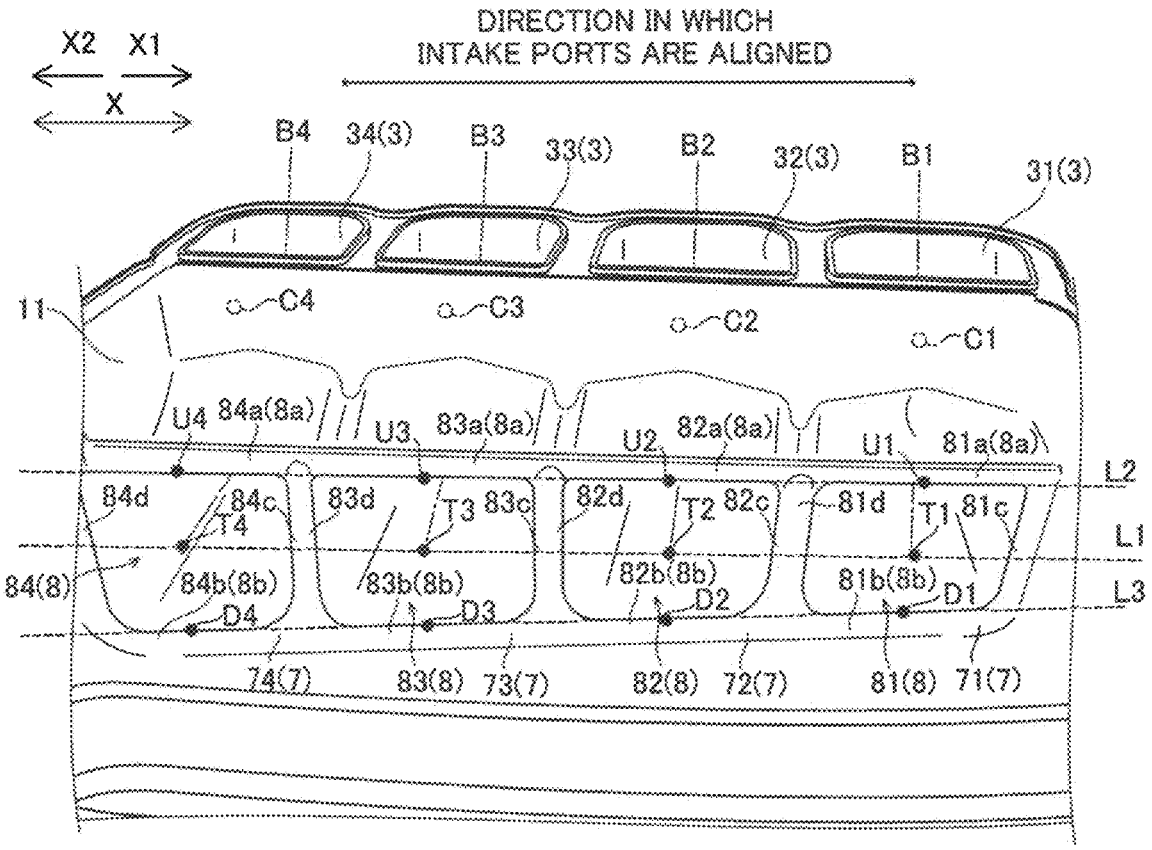
FIG. 10 A perspective view of the lower piece showing respective first center points, respective second center points, and respective third center points of the open ends of the plurality of funnel-shaped portions in the air intake apparatus according to the embodiment of the present invention.

As shown in FIG. 10, inner edges 8*a* of the plurality of intake ports 3 in the lower piece 11 respective have second center points U1, U2, U3, and U4 located in the central portions in the direction in which the plurality of intake ports 3 are aligned. Specifically, the first inner edge 81*a* of the first open end 81 has the second center point U1 located in the central portion in the direction (X direction) in which the plurality of intake ports 3 are aligned. The second inner edge 82*a* of the second open end 82 has the second center point U2 located in the central portion in the direction (X direction) in which the plurality of intake ports 3 are aligned. The third inner edge 83*a* of the third open end 83 has the second center point U3 disposed in the central portion in the direction (X direction) in which the plurality of intake ports 3 are aligned. The fourth inner edge 84*a* of the fourth open end 84 has the second center point U4 located in the central portion in the direction (X direction) in which the plurality of intake ports 3 are aligned.

A line connecting the second center point U1 of the first inner edge 81*a*, the second center point U2 of the second inner edge 82*a*, the second center point U3 of the third inner edge 83*a*, and the second center point U4 of the fourth inner edge 84*a* that are adjacent to each other is a second straight line L2. As shown in FIG. 9, on the second straight line L2, the second center point U1 of the first inner edge 81*a* and the second center point U4 of the fourth inner edge 84*a* are offset from each other by an interval R2 in the Z direction.

Outer edges 8*b* of the plurality of intake ports 3 in the lower piece 11 respectively have third center points D1, D2, D3, and D4 located in the central portions in the direction (X direction) in which the plurality of intake ports 3 are aligned. Specifically, the first outer edge 81*b* of the first open end 81 has the third center point D1 located in the central portion in the direction (X direction) in which the plurality of intake ports 3 are aligned. The second outer edge 82*b* of the second open end 82 has the third center point D2 located in the central portion in the direction (X direction) in which the plurality of intake ports 3 are aligned. The third outer edge 83*b* of the third open end 83 has the third center point D3 located in the central portion in the direction (X direction) in which the plurality of intake ports 3 are aligned. The fourth outer edge 84*b* of the fourth open end 84 has the third center point D4 located in the central portion in the direction in which the plurality of intake ports 3 are aligned.

A line connecting the third center point D1 of the first outer edge 81*b*, the third center point D2 of the second outer edge 82*b*, the third center point D3 of the third outer edge 83*b*, and the third center point D4 of the fourth outer edge 84*b* that are adjacent to each other is a third straight line L3. As shown in FIG. 9, on the third straight line L3, the third center point D1 of the first outer edge 81*b* and the third center point D4 of the fourth outer edge 84*b* are offset from each other by an interval R3 in the Z direction.

Furthermore, as shown in FIG. 9, on the first straight line L1, the first center point T1 of the first open end 81 and the first center point T4 of the fourth open end 84 are offset from each other by an interval R4 in the direction Z.

As shown in FIG. 11, the second straight line L2 is located at a twisted position with respect to the third straight line L3, and each of the second straight line L2 and the third straight line L3 is located at a twisted position with respect to the first straight line L1. Specifically, as shown in FIG. 9, the first straight line L1, the second straight line L2, and the third straight line L3 do not intersect with each other.

Furthermore, as shown in FIG. 11, on the first straight line L1, the first center point T1 and the first center point T4 are offset from each other by the interval R4 in the Z direction, and thus the first straight line L1 is inclined in such a manner that the first center points are further away from the surge tank 2 from the fourth port 34 toward the first port 31. On the second straight line L2, the second center point U1 and the second center point U4 are offset from each other by the interval R2 in the Z direction, and thus the second straight line L2 is inclined in such a manner that the second center points are further away from the surge tank 2 from the fourth port 34 toward the first port 31, but less inclined than the first straight line L1. On the third straight line L3, the third center point D1 and the third center point D4 are offset from each other by the interval R3 in the Z direction, and thus the third straight line L3 is inclined in such a manner that the third center points are further away from the surge tank 2 from the fourth port 34 toward the first port 31, but more inclined than the first straight line L1. Therefore, the first straight line L1, the second straight line L2, and the third straight line L3 are not parallel to each other. Thus, the first straight line L1, the second straight line L2, and the third straight line L3 are twisted relative to each other.

In the air intake apparatus 1, the open ends 8 of the funnel-shaped portions 7 are provided in such a manner as to be twisted along the direction (X direction) in which the plurality of intake ports 3 are aligned due to the second straight line L2 and the third straight line L3. Specifically, as shown in FIG. 11, from the fourth port 34 toward the first port 31, the second straight line L2 is inclined further away from the surge tank 2 while the third straight line L3 is inclined further away from the surge tank 2, and thus the open ends 8 are rotated in such a manner as to further fall to the surge tank 2 side from the fourth open end 84 toward the first open end 81. The wording "the open ends 8 are rotated in such a manner as to further fall to the surge tank 2 side" indicates that a state in which the open ends 8 face the Y2 side and the Z1 side turns to a state in which the open ends 8 face the Y1 side and the Z1 side.

<Boundary Wall>

Figure 12:
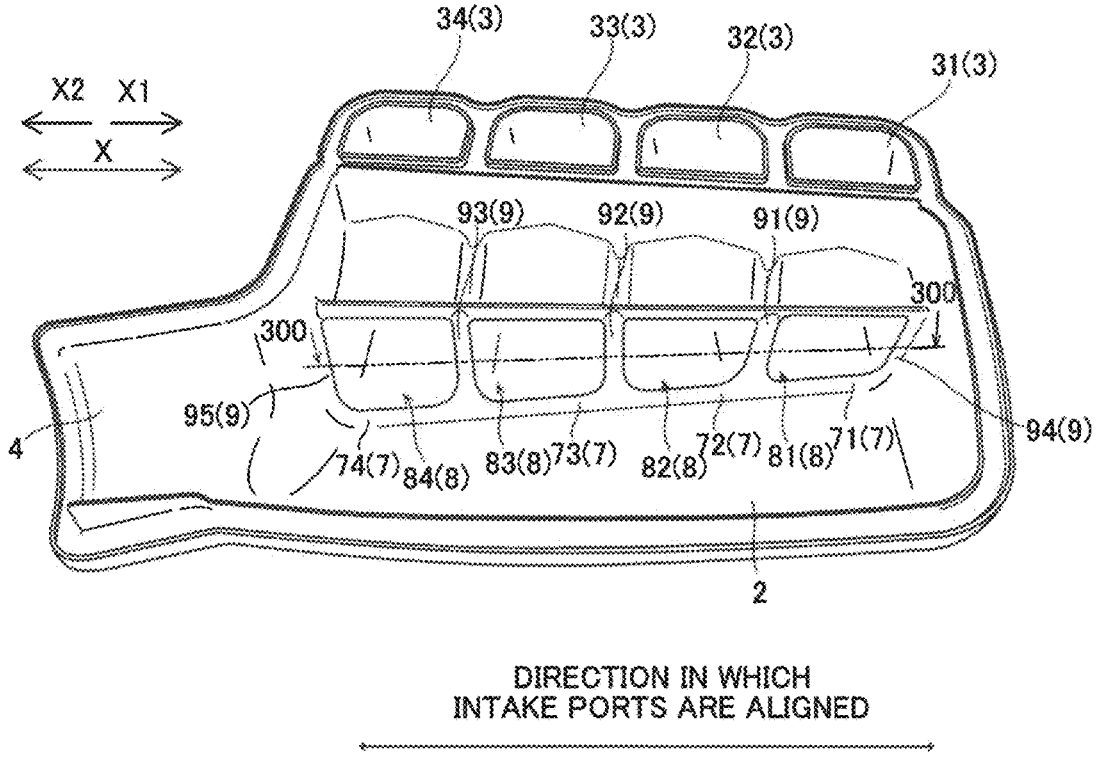
FIG. 12 A perspective view of the lower piece of FIG. 5 as viewed from above.

As shown in FIG. 12, the air intake apparatus 1 is formed with a plurality of boundary walls 9 positioned between the plurality of adjacent funnel-shaped portions 7. Ends of the boundary walls 9 on the surge tank 2 side each have an arcuate shape (see FIG. 13) that protrudes toward the surge tank 2. The boundary walls 9 include a first boundary wall 91 located between the first open end 81 of the first funnel 71 and the second open end 82 of the second funnel 72. The boundary walls 9 also include a second boundary wall 92 located between the second open end 82 of the second funnel 72 and the third open end 83 of the third funnel 73. The boundary walls 9 also include a third boundary wall 93 located between the third open end 83 of the third funnel 73 and the fourth open end 84 of the fourth funnel 74.

Figure 13:
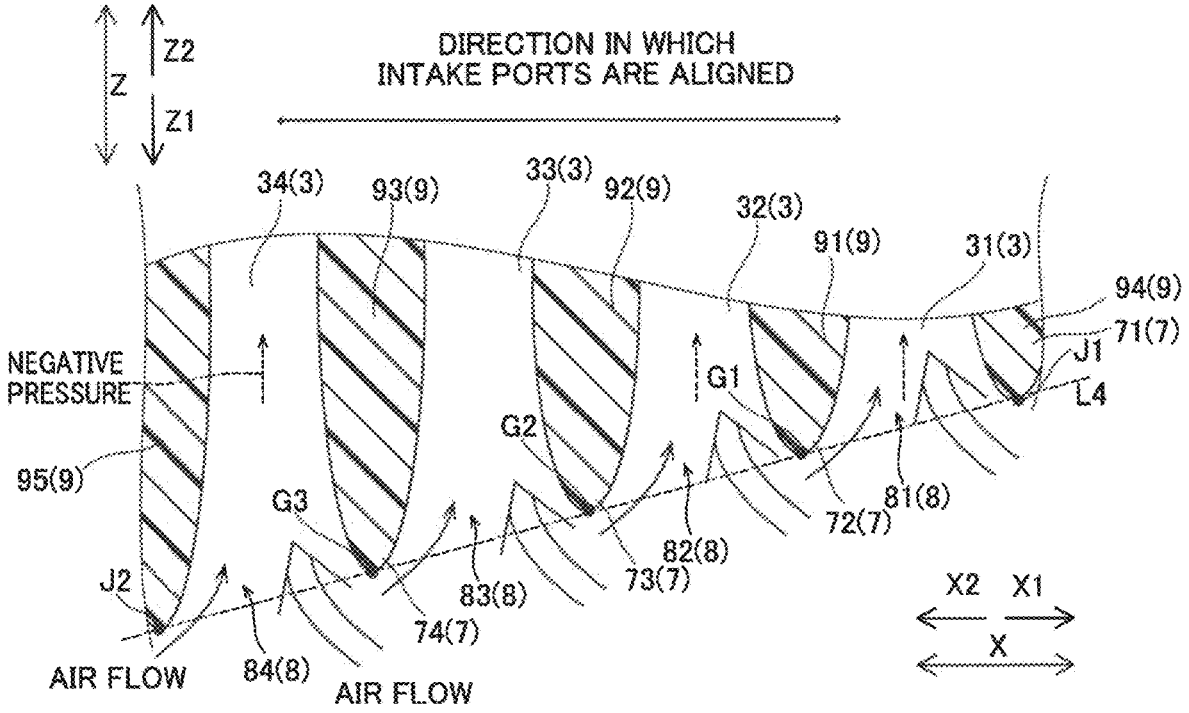
FIG. 13 A sectional view taken along the line 300-300 in FIG. 12.

As shown in FIG. 13, a fourth straight line L4 that connects end points G1, G2, and G3 of the plurality of boundary walls 9 on the surge tank 2 side is inclined with respect to the direction (X direction) in which the plurality of intake ports 3 are aligned. Thus, in the adjacent funnel-shaped portions 7, the inner edges 8*a* are connected to each other by the boundary walls 9 so as to be smoothly inclined with no step therebetween while the outer edges 8*b* are connected to each other by the boundary walls 9 so as to be smoothly inclined with no step therebetween.

The end point G1 of the first boundary wall 91 is located closer to the surge tank 2 than an end point J1 of a first side wall 94 on the first one side edge 81*c* side in the direction (X direction) in which the intake ports 3 are aligned. That is, the end point J1 of the first side wall 94 is located closer to the cylinders 6 in the air flow direction of the first port 31. Therefore, a negative pressure generated in the first port 31 is higher in the first funnel 71 on the end point J1 side of the first side wall 94 than on the end point G1 side of the first boundary wall 91. Thus, the air flow is stronger on the end point J1 side of the first side wall 94 than on the end point G1 side of the first boundary wall 91.

As shown in FIG. 13, the end point G2 of the second boundary wall 92 is located closer to the surge tank 2 than the end point G1 of the first boundary wall 91. That is, the end point G1 of the first side wall 94 is located closer to the cylinders 6 in the air flow direction of the second port 32. Therefore, a negative pressure generated in the second port 32 is higher in the second funnel 72 on the end point G1 side of the first boundary wall 91 than on the end point G2 side of the second boundary wall 92. Thus, the air flow is stronger on the end point G1 side of the first boundary wall 91 than on the end point G2 side of the second boundary wall 92.

The end point G3 of the third boundary wall 93 is located closer to the surge tank 2 than the end point G2 of the second boundary wall 92. That is, the end point G2 of the second boundary wall 92 is located closer to the cylinders 6 in the air flow direction of the third port 33. Therefore, a negative pressure generated in the third port 33 is higher in the third funnel 73 on the end point G2 side of the second boundary wall 92 than on the end point G3 side of the third boundary wall 93. Thus, the air flow is stronger on the end point G2 side of the second boundary wall 92 than on the end point G3 side of the third boundary wall 93.

An end point J2 of a second side wall 95 on the fourth other side edge 84*d* side in the direction (X direction) in which the intake ports 3 are aligned is located closer to the surge tank 2 than the end point G3 of the third boundary wall 93. That is, the end point G3 of the third side wall is located closer to the cylinders 6 in the air flow direction of the fourth port 34. Therefore, a negative pressure generated in the fourth port 34 is higher in the fourth funnel 74 on the end point G3 side of the third boundary wall 93 than on the end point J2 side of the second side wall 95. Thus, the air flow is stronger on the end point G3 side of the third boundary wall 93 than on the end point J2 side of the second side wall 95.

Advantageous Effects of this Embodiment

According to this embodiment, the following advantageous effects are achieved.

According to this embodiment, the funnel-shaped portions 7 include the open ends 8 arranged at the positions at which the lengths of the intake ports 3 from their ends on the surge tank 2 side to their ends on the cylinder 6 side are aligned with each other in the plurality of intake ports 3, the open ends 8 being provided along the direction perpendicular to the direction in which the centerlines B extend. Accordingly, the pulsation frequencies of the plurality of intake ports 3 can be aligned with each other. Furthermore, the open ends 8 are provided in the direction perpendicular to the centerlines B of the intake ports 3, and thus it is possible to facilitate air inflow from the surge tank 2 into the intake ports 3 along the centerlines B of the intake ports 3. Consequently, a pressure loss that occurs in the flow of the air introduced from the surge tank 2 into the intake ports 3 can be significantly reduced or prevented.

According to this embodiment, the lengths of the plurality of intake ports 3 from their ends on the surge tank 2 side to their ends on the cylinder 6 side are aligned with each other, and thus the amount of air that flows through each of the plurality of intake ports 3 can be easily distributed evenly.

According to this embodiment, the pulsation frequencies of the plurality of intake ports 3 can be aligned with each other, and thus the amount of air supplied to the plurality of cylinders 6 can be increased as compared with the case in which the pulsation frequencies of the plurality of intake ports 3 are not aligned with each other.

According to this embodiment, the first straight line L1 is inclined such that one of the open ends 8 of the adjacent funnel-shaped portions 7 is located closer to the cylinders 6 than the other of the open ends 8 of the adjacent funnel-shaped portions 7. Accordingly, even when a large curve is formed in one intake port 3, the lengths of the plurality of intake ports 3 can be adjusted by offsetting the extension of one intake port 3 due to the curve by one funnel-shaped portion 7 disposed closer to the cylinders 6. Consequently, the lengths of the plurality of intake ports 3 can be easily aligned.

According to this embodiment, at the open ends 8 of the adjacent funnel-shaped portions 7, the second straight line L2 that connects the second center points U1, U2, U3, and U4 of the inner edges 8*a* and the third straight line L3 that connects the third center points D1, D2, D3, and D4 of the outer edges 8*b* can be arranged in such a manner as to be twisted relative to each other. Accordingly, surfaces (the first opening A1, the second opening A2, the third opening A3, and the fourth opening A4) defined by the second straight line L2 and the third straight line L3 can be provided in such a manner as to be twisted along the direction in which the plurality of intake ports 3 are aligned. Consequently, the open ends 8 of the adjacent funnel-shaped portions 7 provided along the direction perpendicular to the centerlines B of the intake ports 3 can be continuously connected along a direction inclined with respect to the direction in which the intake ports 3 are aligned.

According to this embodiment, the inner edges 8*a* are connected to each other with no step therebetween while the outer edges 8*b* are connected to each other with no step therebetween, and thus the open ends 8 of the adjacent funnel-shaped portions 7 provided along the direction perpendicular to the centerlines B of the intake ports 3 can be smoothly connected along the direction inclined with respect to the direction in which the intake ports 3 are aligned. Thus, the pressure loss that occurs in the flow of the air introduced from the surge tank 2 into the intake ports 3 can be further significantly reduced or prevented.

According to this embodiment, the funnel-shaped portion 7 is disposed closest to the side opening 4 of the surge tank 2 such that the area of the opening of the open end 8 of the funnel-shaped portion 7 into which air is least likely to flow from the surge tank 2 can be maximized. Furthermore, the funnel-shaped portion 7 is disposed further away from the side opening 4 such that the area of the opening of the open end 8 of the funnel-shaped portion 7 into which air is more likely to flow from the surge tank 2 can be made smaller. Accordingly, the amount of air introduced into the plurality of intake ports 3 can be made approximately uniform.

According to this embodiment, the ends of the boundary walls 9 on the surge tank 2 side each have an arcuate shape that protrudes toward the surge tank 2, and thus it is possible to facilitate air inflow into the plurality of intake ports 3.

According to this embodiment, the entire first straight line L1 that connects the first center points T1, T2, T3, and T4 is inclined at the same angle with respect to the direction (X direction) in which the plurality of intake ports 3 are aligned, and thus a disturbance in the flow of air that flows into the plurality of intake ports 3 can be significantly reduced or prevented. Thus, the pressure loss that occurs in the air intake apparatus 1 can be significantly reduced or prevented.

First Modified Example

An air intake apparatus 201 according to a first modified example of this embodiment is now described with reference to FIGS. 14 to 16. In the air intake apparatus 201 according to the first modified example, the arrangement positions of funnel-shaped portions 207 are different from those of the air intake apparatus 201 according to this embodiment. In the drawings, the same structures as those of the aforementioned embodiment are denoted by the same reference numerals, and description thereof is omitted.

Figure 14:
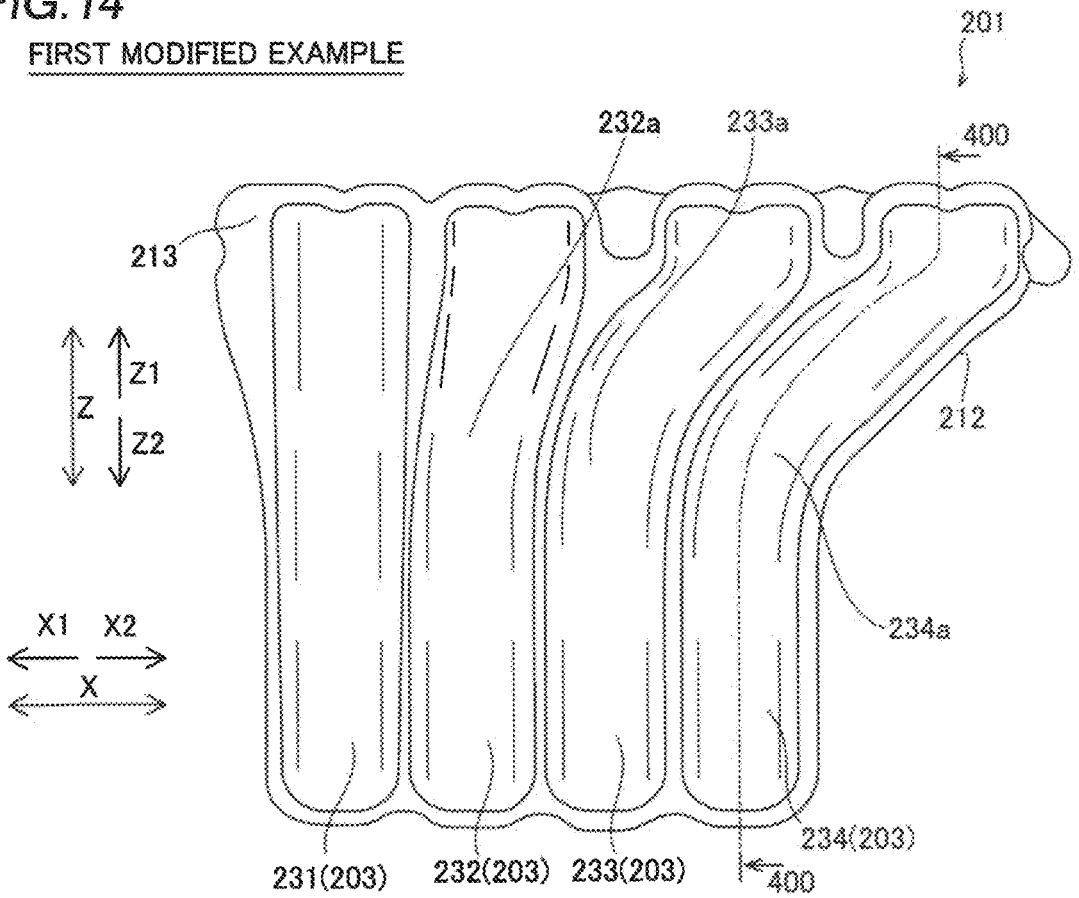
FIG. 14 A rear view showing the structure of an air intake apparatus according to a first modified example of the present invention.

As shown in FIG. 14, a middle piece 212 and an upper piece 213 each include a second curved portion 232*a*, a third curved portion 233*a*, and a fourth curved portion 234*a*, each of which has a spiral portion curved in an X2 direction. In the middle piece 212 and the upper piece 213, the fourth curved portion 234*a* of a fourth port 234 is most strongly curved to the X2 side, the third curved portion 233*a* of a third port 233 is second most strongly curved to the X2 side, and the second curved portion 232*a* of the second port 232 is least strongly curved to the X2 side. In the middle piece 212 and the upper piece 213, the first port 31 is not curved.

In the middle piece 212 and the upper piece 213, the length of the fourth port 234 in an air flow direction is longer than the length of the third port 233 in the air flow direction. In the upper piece 213, the length of the third port 233 in the air flow direction is longer than the length of the second port 232 in the air flow direction. In the upper piece 213, the length of the second port 232 in the air flow direction is longer than the length of the first port 231 in the air flow direction.

<Arrangement Position of Funnel-Shaped Portion>

Figure 15:
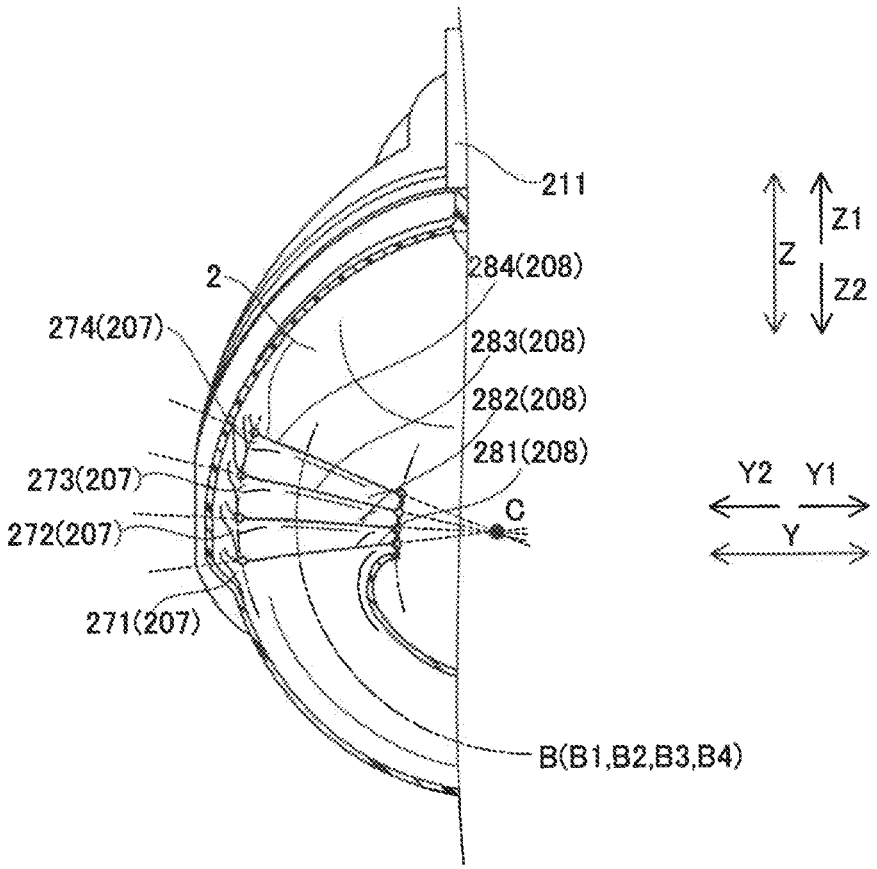
FIG. 15 A partial sectional view taken along the line 400-400 in FIG. 14.

As shown in FIGS. 14 and 15, in the middle piece 212 and the upper piece 213, the length of the fourth port 234 is the longest among a plurality of intake ports 203, and thus in a lower piece 211, the length of the fourth port 234 is the shortest among the plurality of intake ports 203. Therefore, a fourth funnel 274 is located closest to cylinders 6 in the air flow direction as compared with a first funnel 271, a second funnel 272, and a third funnel 273.

In the middle piece 212 and the upper piece 213, the length of the third port 233 is the second longest among the plurality of intake ports 203, and thus in the lower piece 211, the length of the third port 233 is the second shortest among the plurality of intake ports 203. Therefore, the third funnel 273 is located closer to the cylinders 6 in the air flow direction than both the first funnel 271 and the second funnel 272. Furthermore, the third funnel 273 is located closer to the surge tank 2 in the air flow direction than the fourth funnel 274.

In the middle piece 212 and the upper piece 213, the length of the second port 232 is the third longest among the plurality of intake ports 203, and thus in the lower piece 211, the length of the second port 232 is the third shortest among the plurality of intake ports 203. Therefore, the second funnel 272 is located closer to the cylinders 6 in the air flow direction than the first funnel 271. Furthermore, the second funnel 272 is located closer to the surge tank 2 in the air flow direction than both the third funnel 273 and the fourth funnel 274.

In the middle piece 212 and the upper piece 213, the length of the first port 231 is the shortest among the plurality of intake ports 203, and thus in the lower piece 211, the length of the first port 231 is the longest among the plurality of intake ports 203. Therefore, the first funnel 271 is located closest to the surge tank 2 in the air flow direction as compared with the second funnel 272, the third funnel 273, and the fourth funnel 274.

<Open End of Funnel-Shaped Portion>

Figure 16:
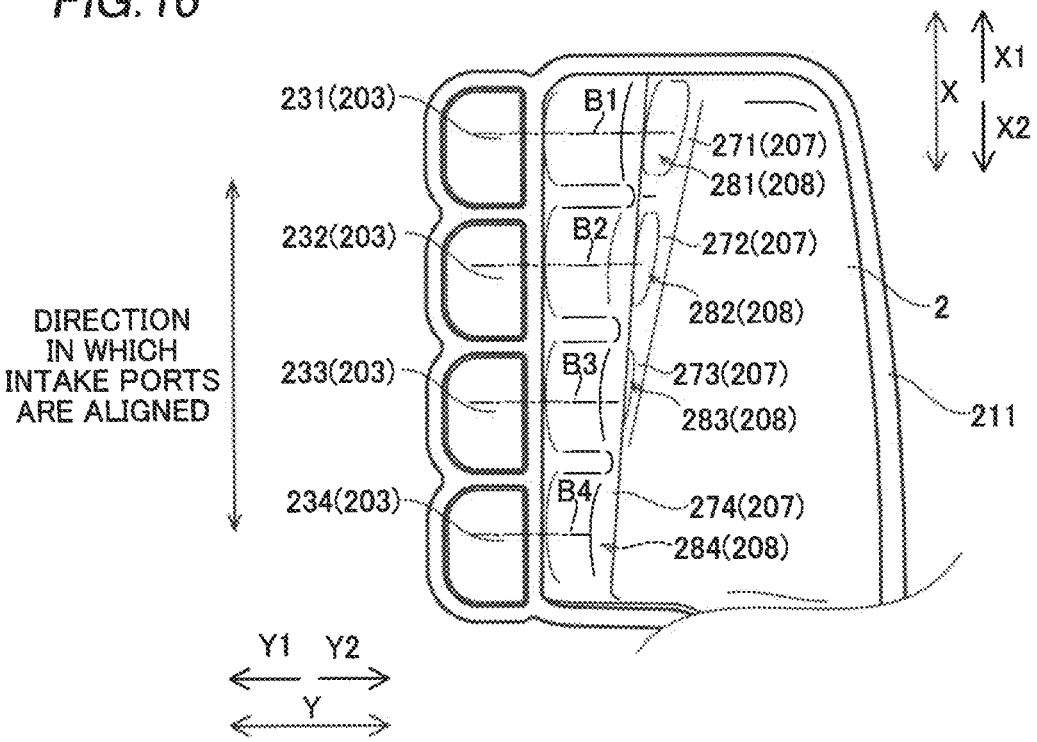
FIG. 16 A plan view showing a lower piece of the air intake apparatus according to the first modified example of the present invention.

As shown in FIG. 16, the first funnel 271 includes a first open end 281 as an open end 208 formed along a direction perpendicular to a direction in which the centerline B1 of the first port 231 extends in the lower piece 211. The second funnel 272 includes a second open end 282 as an open end 208 formed along a direction perpendicular to a direction in which the centerline B2 of the second port 232 extends in the lower piece 211. The third funnel 273 includes a third open end 283 as an open end 208 formed along a direction perpendicular to a direction in which the centerline B3 of the third port 233 extends in the lower piece 211. The fourth funnel 274 includes a fourth open end 284 as an open end 208 formed along a direction perpendicular to a direction in which the centerline B4 of the fourth port 234 extends in the lower piece 211. The remaining structures and advantageous effects of the first modified example are similar to those of the aforementioned embodiment.

Second Modified Example

An air intake apparatus 301 according to a second modified example of this embodiment is now described with reference to FIGS. 17 to 19. In the air intake apparatus 301 according to the second modified example, the arrangement positions of funnel-shaped portions 307 are different from those of the air intake apparatus 1 according to this embodiment. In the drawings, the same structures as those of the aforementioned embodiment are denoted by the same reference numerals, and description thereof is omitted.

Figure 17:
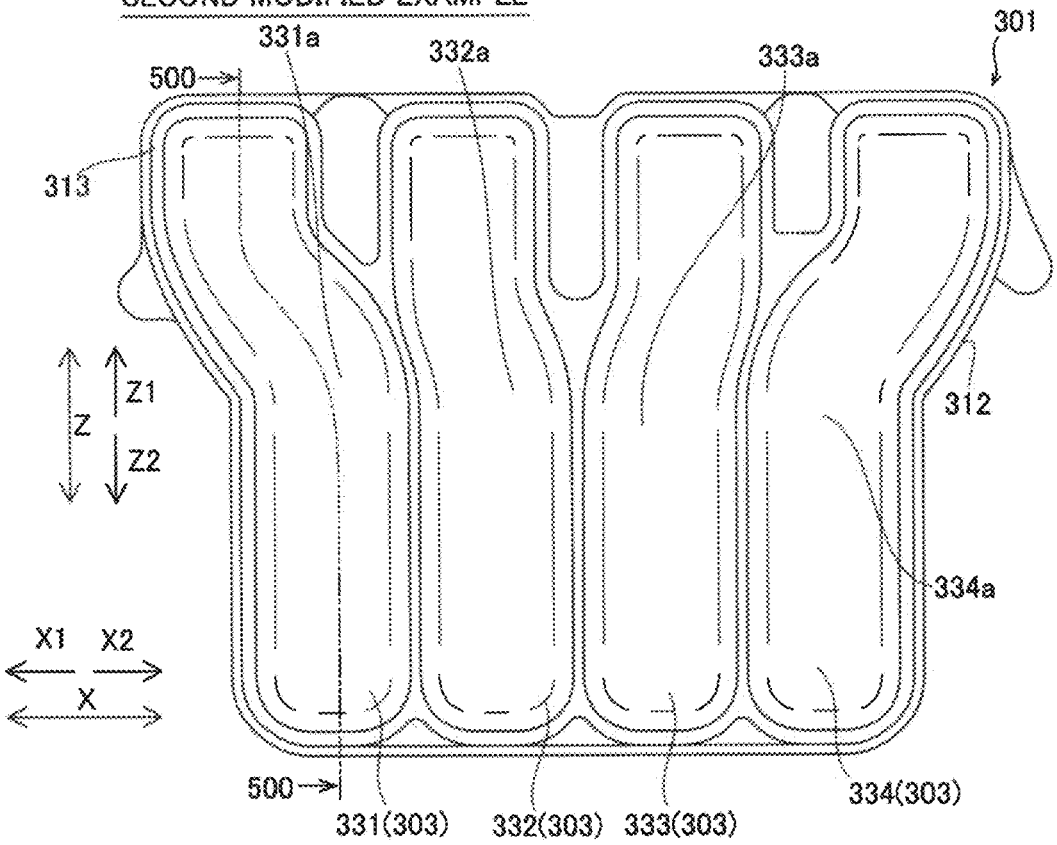
FIG. 17 A rear view showing the structure of an air intake apparatus according to a second modified example of the present invention.

As shown in FIG. 17, a middle piece 312 and an upper piece 313 each include a first curved portion 331*a*, a second curved portion 332*a*, a third curved portion 333*a*, and a fourth curved portion 334*a*, each of which has a spiral portion curved in an X1 direction or an X2 direction. In the middle piece 312 and the upper piece 313, the first curved portion 331*a* of a first port 331 is more strongly curved to the X1 side than the second curved portion 332*a* of a second port 332. Furthermore, in the middle piece 312 and the upper piece 313, the fourth curved portion 334*a* of a fourth port 334 is more strongly curved to the X2 side than the third curved portion 333*a* of a third port 33. The first curved portion 331*a* and the fourth curved portion 334*a* are mirror images of each other. In addition, the second curved portion 332*a* and the third curved portion 333*a* are mirror images of each other.

In the upper piece 313, the length of the first port 331 in an air flow direction is longer than the length of the second port 332 in the air flow direction. In the upper piece 313, the length of the fourth port 334 in the air flow direction is longer than the length of the third port 333 in the air flow direction. In addition, the length of the first port 331 in the air flow direction is the same as the length of the fourth port 334 in the air flow direction. The length of the second port 332 in the air flow direction is the same as the length of the third port 333 in the air flow direction.

<Arrangement Position of Funnel-Shaped Portion>

Figure 18:
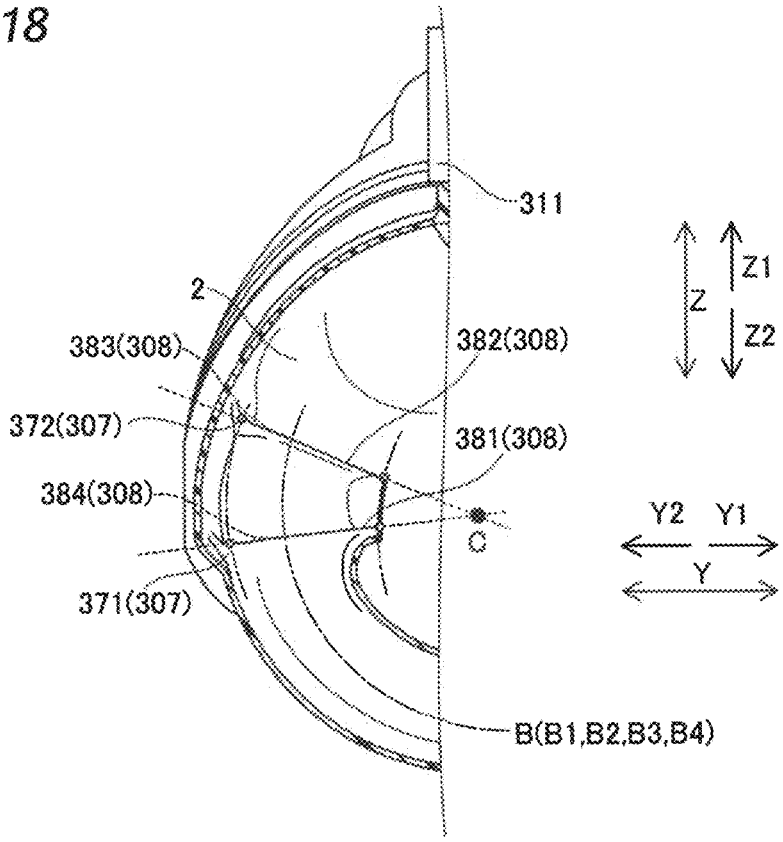
FIG. 18 A partial sectional view taken along the line 500-500 in FIG. 17.

As shown in FIG. 18, in the middle piece 312 and the upper piece 313, the lengths of the first port 331 and the fourth port 334 are the same as each other and are longer than the lengths of the second port 332 and the third port 333, and thus in a lower piece 311, the lengths of the first port 331 and the fourth port 334 are shorter than the lengths of the second port 332 and the third port 333. Therefore, as shown in FIG. 19, a first funnel 371 and a fourth funnel 374 are located closer to cylinders 6 in the air flow direction than a second funnel 372 and a third funnel 373.

<Open End of Funnel-Shaped Portion>

Figure 19:
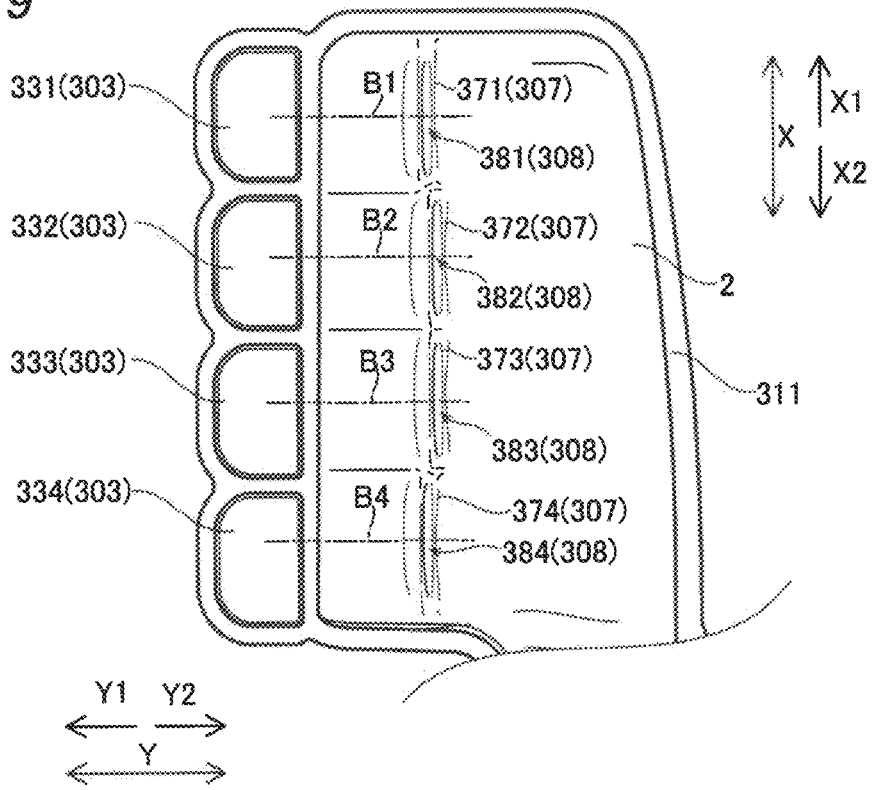
FIG. 19 A plan view showing a lower piece of the air intake apparatus according to the second modified example of the present invention.

As shown in FIG. 19, the first funnel 371 includes a first open end 381 as an open end 308 formed along a direction perpendicular to a direction in which the centerline B1 of the first port 331 extends in the lower piece 311. The second funnel 372 includes a second open end 382 as an open end 308 formed along a direction perpendicular to a direction in which the centerline B2 of the second port 332 extends in the lower piece 311. The third funnel 373 includes a third open end 383 as an open end 308 formed along a direction perpendicular to a direction in which the centerline B3 of the third port 333 extends in the lower piece 311. The fourth funnel 374 includes a fourth open end 384 as an open end 308 formed along a direction perpendicular to a direction in which the centerline B4 of the fourth port 334 extends in the lower piece 311. The remaining structures and advantageous effects of the second modified example are similar to those of the aforementioned embodiment.

Modified Examples

The embodiment disclosed this time must be considered as illustrative in all points and not restrictive. The scope of the present invention is not shown by the above description of the embodiment but by the scope of claims for patent, and all modifications (modified examples) within the meaning and scope equivalent to the scope of claims for patent are further included.

For example, while the air intake apparatuses 1, 201, and 301 are each provided in an in-line four-cylinder engine for an automobile in the aforementioned embodiment, the present invention is not restricted to this. The present invention may be provided in an engine other than an in-line four-cylinder engine for an automobile.

While the open ends 8, 208, and 308 of the funnel-shaped portions 7, 207, and 307 are rectangular in the aforementioned embodiment, the present invention is not restricted to this. For example, the open ends of the funnel-shaped portions may be circular or elliptical.

While the area of the opening in the cross section of each of the intake ports 3, 203, and 303 increases from the cylinder 6 side toward the surge tank 2 side in the aforementioned embodiment, the present invention is not restricted to this. For example, the area of the opening in the cross section of each of the intake ports may be constant from the cylinder side to the surge tank side.

While each of the boundary walls 9 is formed in an arcuate shape that protrudes toward the surge tank 2 in the aforementioned embodiment, the present invention is not restricted to this. In the present invention, each of the boundary walls may not be formed in an arcuate shape. The boundary walls are preferably inclined in the flow direction of air that flows into the intake ports.

While the straight line L1 that connects the first center points T1, T2, T3, and T4 at the adjacent open ends 8, 208, and 308 is inclined at a constant angle in the aforementioned embodiment, the present invention is not restricted to this. In the present invention, the straight line that connects the first center points at the adjacent open ends may be provided in such a manner that its inclination angle is different on the way.

DESCRIPTION OF REFERENCE NUMERALS

1, 201, 301: air intake apparatus
2: surge tank
3, 203, 303: intake port
4: side opening
5: cylinder head
6: cylinder
7, 207, 307: funnel-shaped portion
8, 208, 308: open end
8*a*: inner edge
8*b*: outer edge
9: boundary wall
A1: first opening
A2: second opening
A3: third opening
A4: fourth opening
B1, B2, B3, B4: centerline
C1, C2, C3, C4: port center point
D1, D2, D3, D4: third center point
L1: first straight line
L2: second straight line
L3: third straight line
T1, T2, T3, T4: first center point
U1, U2, U3, U4: second center point

The invention claimed is:

1. An air intake apparatus comprising: a surge tank including a side opening, into which air is introduced via the side opening; a plurality of intake ports through which the air is introduced from the surge tank to each of a plurality of cylinders of an engine body; and a plurality of funnel-shaped portions provided at ends of the plurality of intake ports on a side of the surge tank; wherein the plurality of funnel-shaped portions respectively include open ends located at positions at which lengths of the plurality of intake ports from ends thereof on the side of the surge tank to ends thereof on sides of the plurality of cylinders are aligned with each other, the open ends being provided along a direction perpendicular to a direction in which respective centerlines of the plurality of intake ports extend, wherein areas of openings in respective cross sections of the plurality of intake ports increase from the sides of the plurality of cylinders toward the side of the surge tank, and among the plurality of funnel-shaped portions, an area of an opening of an open end of a funnel-shaped portion located closest to the side opening of the surge tank is the largest, and an area of an opening of an open end of a funnel-shaped portion located further away from the side opening becomes smaller.

2. The air intake apparatus according to claim 1, wherein a first straight line that connects first center points as positions of the respective centerlines of the plurality of intake ports at the open ends of the plurality of funnel-shaped portions adjacent to each other is inclined with respect to a direction in which the plurality of intake ports are aligned.

3. The air intake apparatus according to claim 2, wherein the respective centerlines of the plurality of intake ports are arcuate, centered on port center points; the open ends of the plurality of funnel-shaped portions include inner edges on sides of the port center points, and outer edges located further away from the port center points than the inner edges; and the open ends of the plurality of funnel-shaped portions are twisted along the direction in which the plurality of intake ports are aligned due to a second straight line that connects second center points in the direction in which the plurality of intake ports are aligned at the inner edges of the open ends of the plurality of adjacent funnel-shaped portions and a third straight line that connects third center points in the direction in which the plurality of intake ports are aligned at the outer edges of the plurality of adjacent funnel-shaped portions.

4. The air intake apparatus according to claim 3, wherein the inner edges of the plurality of adjacent funnel-shaped portions are connected to each other with no step therebetween; and the outer edges of the plurality of adjacent funnel-shaped portions are connected to each other with no step therebetween.

5. The air intake apparatus according to claim 1, wherein ends of boundary walls of the plurality of adjacent funnel-shaped portions on the side of the surge tank each have an arcuate shape that protrudes toward the surge tank.

6. The air intake apparatus according to claim 2, wherein the straight line that connects the first center points at respective open ends of four funnel-shaped portions in a four-cylinder engine is inclined throughout at a constant angle with respect to the direction in which the plurality of intake ports are aligned.

* * * * *